United States Patent [19]

Lassiter

[11] 4,418,504

[45] Dec. 6, 1983

[54] DRAIN SHIELD FOR GUTTERS

[76] Inventor: Will M. Lassiter, 1703 Deep River Rd., High Point, N.C. 27260

[21] Appl. No.: 312,498

[22] Filed: Oct. 19, 1981

[51] Int. Cl.[3] ..... E04D 13/00

[52] U.S. Cl. ..... 52/12; 210/474

[58] Field of Search ..... 52/12; 210/474, 477, 210/499

[56] References Cited

U.S. PATENT DOCUMENTS

| | | | |
|---|---|---|---|
| 460,850 | 10/1891 | Cartis | 52/674 |
| 803,670 | 11/1905 | Crawford | 52/12 |
| 2,271,081 | 1/1942 | Layton | 108/30 |
| 2,288,121 | 6/1942 | Cisar et al. | 108/30 |
| 2,583,422 | 1/1952 | Haddon | 108/30 |
| 2,674,961 | 4/1954 | Lake | 52/12 |
| 2,935,954 | 5/1960 | Matthews et al. | 52/12 |
| 3,053,393 | 9/1962 | McLean | 210/474 |
| 3,080,682 | 3/1963 | Teutsch | 50/5 |
| 3,289,380 | 12/1966 | Charnigar | 52/473 |
| 3,388,555 | 6/1968 | Foster | 61/15 |
| 3,818,667 | 6/1974 | Wagner | 52/673 |

FOREIGN PATENT DOCUMENTS

| | | | |
|---|---|---|---|
| 1132334 | 3/1957 | France | 52/673 |

*Primary Examiner*—Henry E. Raduazo

[57] ABSTRACT

The present invention is concerned with a drain shield for gutters or the like to prevent leaves, pine needles and other debris from entering the gutters and causing them to clog and require periodic cleaning and maintenance. The drain shield shown herein allows rain water to easily enter the gutters while causing leaves, twigs and other debris to be washed over the edge of the gutter to the ground below.

6 Claims, 6 Drawing Figures

DRAIN SHIELD FOR GUTTERS

BACKGROUND AND OBJECTIVES OF THE INVENTION

Roof gutters are constantly in need of cleaning as a result of leaves, pine needles, twigs and other debris which are washed from the roof during rain storms. Homeowners are particularly plagued during the fall season as leaves fall from nearby trees to fill the gutters and block downspouts causing the gutters to overflow. To alleviate this problem, prior art devices have been developed which include screens and other apparatus to stop leaves from entering the gutter and straining devices which prevent the leaves once they have entered the gutter to pass into and down the downspout. However, many of the prior art devices cause more problems than they solve and often-times require more maintenance than the unshielded gutters.

With this background in mind, the present invention was developed and one of its objectives is to provide a gutter shield requiring little routine maintenance.

It is another objective of the present invention to provide a gutter shield which will allow leaves and debris to pass over the edge of the gutter and onto the ground below while allowing rain water to pass uninterrupted into the gutter.

It is another objective of the present invention to provide a gutter shield which is easily installed and which can be manufactured at a relatively low cost.

It is yet another objective of the present invention to provide a drain shield which can be adapted to a variety of conventional gutters rapidly without expensive modifications being made thereto.

SUMMARY OF THE INVENTION AND DESCRIPTION OF THE PREFERRED EMBODIMENT

The invention as disclosed herein demonstrates a gutter shield for positioning on a drain gutter of a house or other building. The shield consists of a planar member which may be made from galvanized sheet metal, plastic, aluminum, copper, or other suitable materials. The planar member has on its upper side a series of arch-like structures which cover or front a series of apertures in the planar member. Thus, leaves or other solid materials cannot clog the apertures but are instead washed over the edge of the shield to the ground below. Rain water on the other hand can enter the apertures and can flow down the gutter to the downspout without undue interference. Trough means are provided aft of the arch means to guide the liquid through the apertures but are protected from leaves and other debris by the arch means.

In the preferred embodiment of the present invention the planar member is constructed of galvanized metal with arch means which are arranged in a series of rows with each said arch means being positioned in a staggered or offset relationship with the arch means in the next succeeding row and with trough means positioned aft of each arch means.

DESCRIPTION OF THE DRAWINGS

Turning now to the drawings,

For a more detailed description of the drawings and explanation of the invention, FIG. 1 illustrates a section of shield 10 of the preferred embodiment of the drain shield of the present invention which may be from metals, plastics, or other suitable materials. It is understood that as many sections as desired will be placed along gutter 14 to insure full protection along its entire length. The drain shield includes a planar base 11 with a series of raised arch-like structures 12 which are positioned forward of trough means 13 and are shown in more detail in FIG. 2. Shield 10 is shown in FIG. 1 positioned to thus protect gutter 14 from becoming clogged with leaves, twigs or other debris which may be encountered. As shown in FIG. 6 trough means 13 is formed so that the rain water will, after entering trough means 13, flow downward in a swirling or turning motion through aperture 19 and down into gutter 14 below. Thus, the direction of the rain water is guided with a spiraling effect prior to its delivery into gutter 14. Shown immediately below gutter 14 is downspout 15 which is a common source of maintenance for unprotected gutters.

Figure 1:
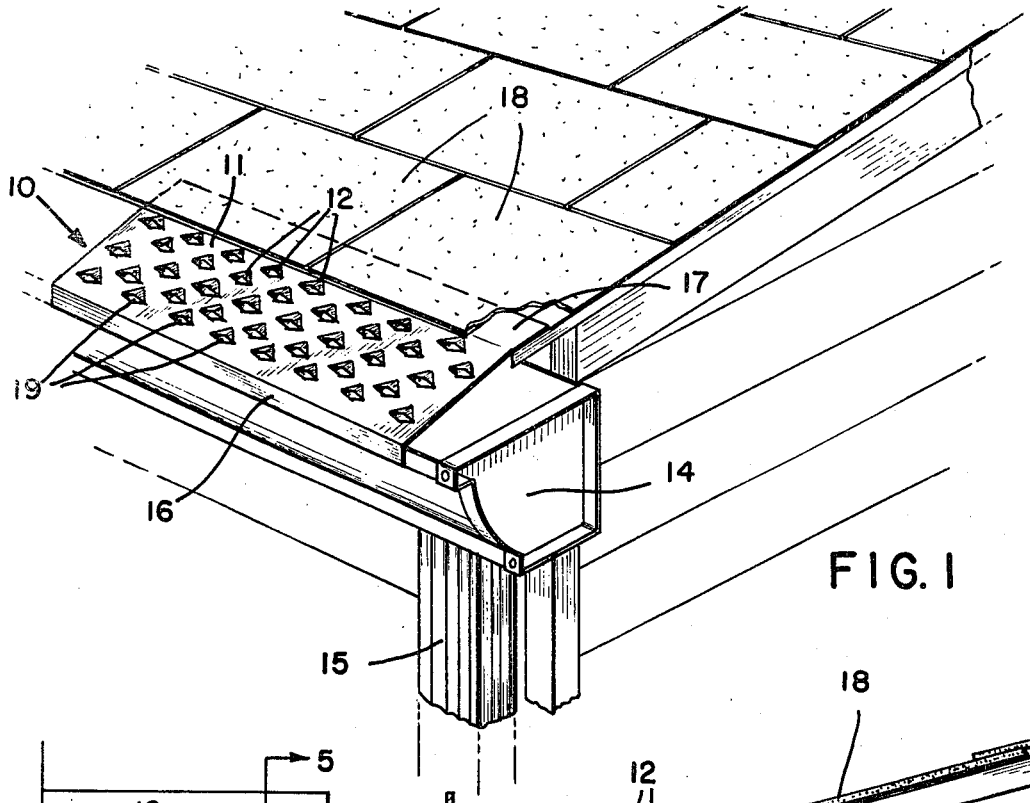
FIG. 1 demonstrates the preferred embodiment of the drain shield positioned on a drain gutter.

In order to firmly secure the drain shield 10 in position the trailing edge of shield 10 is formed into a flange 16 which is used as an attaching means to gutter 14 and may be affixed thereto by sheet metal screws or otherwise. As further shown in FIG. 1 shield 10 is secured in position by allowing its leading edge 17 to rest under roof tile 18. Of course, other methods of securing shield 10 to gutter 14 can be employed by those skilled in the art as particular circumstances may require modifications in the attaching process.

Drain shield 10 can be made in convenient 3 foot lengths when made of rigid materials such as galvanized sheet metal or copper or can be made in longer lengths and rolled up for storage if made of flexible materials such as polyethylene or other durable plastics.

Figure 3:
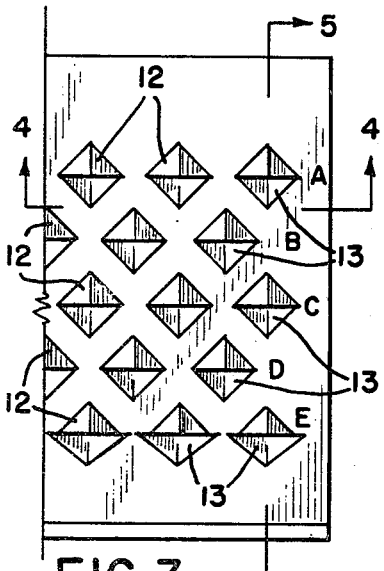
FIG. 3 illustrates a top plan view of the drain shield.
Figure 5:
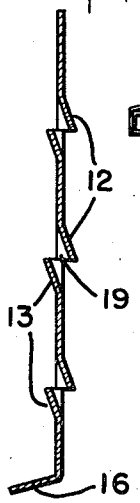
FIG. 5 illustrates another cross sectional view of the drain shield as shown in FIG. 3 taken through lines 5—5.

It has been found that for conventional gutters that a plurality of rows of arch-means are more efficient than a single row and it has been found that five such rows are adequate for conventional home gutters. As shown in FIG. 3 rows are labeled A through E and as further shown row B is offset from rows A and C and trough means 13 are shown immediately aft of arch means 12. Trough means 13 may be the same width as arch means 12 as shown in rows A through D or said trough means may be of a different width as shown in row E where trough means 13 are wider than arch means 12.

Figure 2:
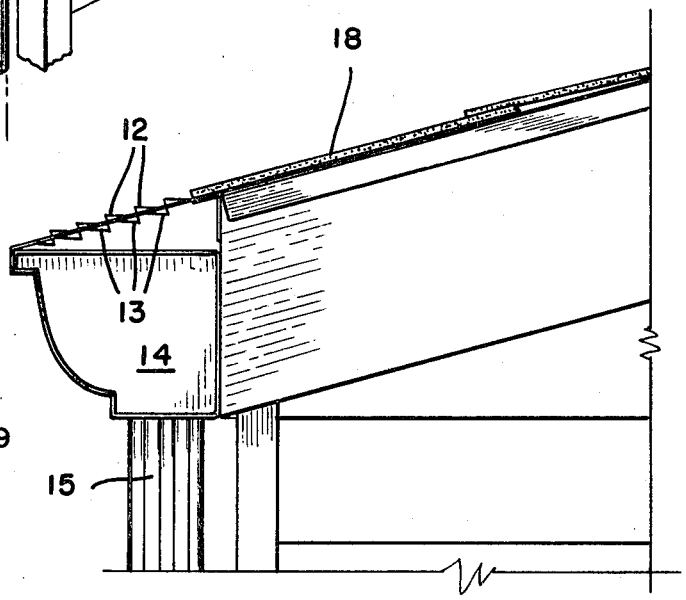
FIG. 2 illustrates a side elevational view of the drain shield shown in FIG. 1.
Figure 4:
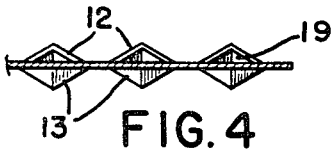
FIG. 4 illustrates a cross sectional view of the drain shield shown in FIG. 3 taken along lines 4—4.
Figure 6:
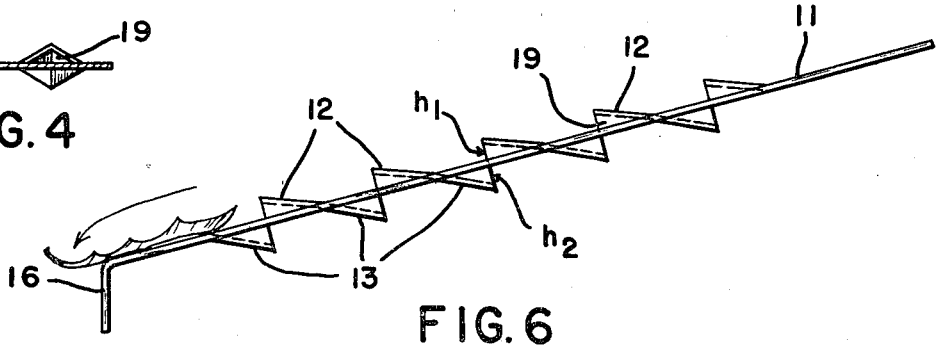
FIG. 6 illustrates an enlarged cross sectional view of the drain shield as depicted in FIG. 2.

Opening 19 in planar base 11 is shown below or down slope from the arch means 12 as illustrated in FIGS. 1 and 6. As would be understood as leaves and water flow down the roof tiles 18 as shown in FIG. 2 towards gutter 14 the leaves and solid debris pass over arch means 12 while the water is deflected into trough means 13 and falls into gutter 14.

As further shown in FIG. 6 arch means 12 may be raised above planar base 11 the same distance ($h_1$) as trough means 13 is lowered (distance $h_2$) from the lower surface of planar base 11. In other words, $h_1$ may be equal or be greater or less than $h_2$ depending upon the requirements of a particular gutter or roof construction. It should be understood by those skilled in the art as the slope of a roof increased $h_2$ would have to increase to insure a downward direction for water which could flow into the gutter 14.

Various modifications can be made by those skilled in the art to the present invention and the examples shown herein are for illustrative purposes.

I claim:

1. A drain shield for a gutter comprising: a planar base member having upper and lower surfaces and adapted to be installed on a roof in a downwardly sloping manner over a gutter, a series of arch means, said arch means raised from said upper surface of said base member, trough means, said trough means extending below said lower surface of said base member and down the slope from said arch means, said arch means having an opening in a down slope position in front of and centered with said trough means.

2. A drain shield as claimed in claim 1 wherein said trough means includes a series of trough means immediately aft or down slope of said arch means.

3. A drain shield for a gutter as claimed in claim 1 wherein said trough means are wider than said arch means.

4. A drain shield for a gutter as claimed in claim 1 wherein said arch means are placed in rows with said arch means positioned in a staggered relationship.

5. A drain shield for a gutter as claimed in claim 1 wherein said base means include a gutter attaching means.

6. A drain shield for a gutter as claimed in claim 1 wherein said arch means and said trough means determine an aperture in said base member.

* * * * *